US007775759B2

(12) United States Patent
Sirakov et al.

(10) Patent No.: US 7,775,759 B2
(45) Date of Patent: Aug. 17, 2010

(54) CENTRIFUGAL COMPRESSOR WITH SURGE CONTROL, AND ASSOCIATED METHOD

(75) Inventors: Borislav Sirakov, Torrance, CA (US); Hua Chen, Blackburn (GB); Nicolas Deschatrettes, Wigan (GB); Junfei Yin, Cranfield (GB); Gary Vrbas, Torrance, CA (US); Dennis Thoren, Torrance, TX (US)

(73) Assignee: Honeywell International Inc., Morristown, NJ (US)

( * ) Notice: Subject to any disclaimer, the term of this patent is extended or adjusted under 35 U.S.C. 154(b) by 721 days.

(21) Appl. No.: 11/696,294

(22) Filed: Apr. 4, 2007

(65) Prior Publication Data

US 2007/0217902 A1 Sep. 20, 2007

Related U.S. Application Data

(63) Continuation-in-part of application No. 10/583,937, filed as application No. PCT/US03/041626 on Dec. 24, 2003.

(51) Int. Cl.
*F04D 29/44* (2006.01)

(52) U.S. Cl. ..... 415/1; 415/58.4; 415/116; 415/206; 415/914

(58) Field of Classification Search ..... 415/1, 415/58.4, 205, 206, 914, 116
See application file for complete search history.

(56) References Cited

U.S. PATENT DOCUMENTS

| | | | | |
|---|---|---|---|---|
| 2,656,096 | A | 10/1953 | Scwarz | |
| 4,375,937 | A * | 3/1983 | Cooper | 415/58.5 |
| 4,930,978 | A | 6/1990 | Khann et al. | |
| 4,981,018 | A * | 1/1991 | Jones et al. | 60/726 |
| 4,990,053 | A * | 2/1991 | Rohne | 415/58.4 |
| 5,282,718 | A * | 2/1994 | Koff et al. | 415/57.3 |
| 5,863,178 | A * | 1/1999 | Scheinert et al. | 415/58.4 |
| 6,447,241 | B2 * | 9/2002 | Nakao | 415/1 |
| 6,517,309 | B1 * | 2/2003 | Zaher | 415/1 |
| 2002/0192073 | A1 | 12/2002 | Japikse | |

FOREIGN PATENT DOCUMENTS

| | | |
|---|---|---|
| GB | 897575 | 5/1962 |
| JP | H9310699 | 12/1997 |
| WO | 2005121560 | 12/2005 |

OTHER PUBLICATIONS

PCT ISR/WO Honeywell.

* cited by examiner

*Primary Examiner*—Ninh H Nguyen
(74) *Attorney, Agent, or Firm*—Alston & Bird

(57) ABSTRACT

A centrifugal compressor for compressing a fluid comprises a compressor wheel having a plurality of circumferentially spaced blades, and a compressor housing in which the compressor wheel is mounted. The compressor housing includes an inlet duct through which the fluid enters in an axial direction and is led by the inlet duct into the compressor wheel, and a wheel shroud located radially adjacent the tips of the blades. A bleed port is defined in the wheel shroud at a location intermediate the leading and trailing edges of the blades for bleeding off a bleed portion of the fluid being compressed by the compressor wheel. A converging injection nozzle is defined in the duct wall upstream of the leading edges of the blades for injecting the bleed portion of the fluid back into the main fluid flow stream approaching the compressor wheel.

15 Claims, 2 Drawing Sheets

CENTRIFUGAL COMPRESSOR WITH SURGE CONTROL, AND ASSOCIATED METHOD

CROSS-REFERENCE TO RELATED APPLICATION

This application is a continuation-in-part of co-pending U.S. patent application Ser. No. 10/583,937 filed on Jul. 2, 2008, the entire disclosure of which is hereby incorporated herein by reference, and which in turn claims priority to International Patent Application PCT/US2003/041626 filed on Dec. 24, 2003.

BACKGROUND OF THE INVENTION

The present disclosure relates to centrifugal compressors used for compressing a fluid such as air, and more particularly relates to centrifugal compressors and methods in which surge of the compressor is controlled by bleeding off a portion of the at least partially compressed fluid and recirculating the portion to the inlet of the compressor.

Centrifugal compressors are used in a variety of applications for compressing fluids, and are particularly suitable for applications in which a relatively low overall pressure ratio is needed. A single-stage centrifugal compressor can achieve peak pressure ratios approaching about 4.0 and is much more compact in size than an axial flow compressor of equivalent pressure ratio. Accordingly, centrifugal compressors are commonly used in turbochargers for boosting the performance of gasoline and diesel engines for vehicles.

In turbocharger applications, it is important for the compressor to have a wide operating envelope, as measured between the "choke line" at which the mass flow rate through the compressor reaches a maximum possible value because of sonic flow conditions in the compressor blade passages, and the "surge line" at which the compressor begins to surge with reduction in flow at constant pressure ratio or increase in pressure ratio at constant flow. Compressor surge is a compression system instability associated with flow oscillations through the whole compressor system. It is usually initiated by aerodynamic stall or flow separation in one or more of the compressor components as a result of exceeding the limiting flow incidence angle to the compressor blades or exceeding the limiting flow passage loading.

Surge causes a significant loss in performance and thus is highly undesirable. In some cases, compressor surge can also result in damage to the engine or its intake pipe system.

Thus, there exists a need for an improved apparatus and method for providing compressed fluid, such as in a turbocharger, while reducing the occurrence of compressor surge. In some cases, the prevention of compressor surge can expand the useful operating range of the compressor.

BRIEF SUMMARY OF THE DISCLOSURE

The present disclosure is directed to a centrifugal compressor having a fluid recirculation system aimed at controlling surge. In accordance with one embodiment disclosed herein, a centrifugal compressor for compressing a fluid comprises a compressor wheel having a plurality of circumferentially spaced blades, and a compressor housing in which the compressor wheel is mounted so as to be rotatable about the rotational axis of the compressor wheel. The compressor housing includes an inlet duct through which the fluid enters in a direction generally parallel to the rotational axis of the compressor wheel and is led by the inlet duct into the compressor wheel, the inlet duct comprising a duct wall that encircles the rotational axis, the compressor housing further including a wheel shroud located radially adjacent the tips of the blades. A bleed port is defined in the wheel shroud at a location intermediate the leading and trailing edges of the blades for bleeding off a bleed portion of the fluid being compressed by the compressor wheel. A converging injection nozzle is defined in the duct wall upstream of the leading edges of the blades for injecting the bleed portion of the fluid back into the main fluid flow stream approaching the compressor wheel.

The injection nozzle is configured such that the bleed portion is injected into the main fluid flow stream along a direction that makes an angle of from 0° to 90° with respect to the rotational axis of the compressor wheel. Additionally, the injection nozzle is configured such that a flow area of the injection nozzle decreases in the flow direction such that the bleed portion is accelerated before being injected into the main fluid flow stream.

In one embodiment, the bleed port is connected to the injection nozzle by a connecting passage defined in the compressor housing, and the flowpath defined by the connecting passage and the injection nozzle is free of abrupt steps.

If desired, the compressor can include a plurality of guide vanes disposed in the connecting passage and configured to alter a degree of swirl in the bleed portion prior to the bleed portion being discharged through the injection nozzle. The guide vanes can reduce the swirl of the bleed portion substantially to zero before it is injected into the main fluid flow stream. Alternatively, the guide vanes can reduce the swirl to a non-zero level having the same rotational direction as the compressor wheel (so-called "preswirl"), or can reverse the swirl direction such that the bleed portion is injected with a swirl opposite to the compressor wheel rotation (so-called "counterswirl").

The flow area of the bleed port can be sized such that at a predetermined operating condition the mass flow rate of the bleed portion comprises more than 5% of the total mass flow rate of the fluid entering the inlet duct, more particularly more than 10% of the total mass flow rate, and still more particularly more than 15% of the total mass flow rate.

In one embodiment, the bleed port is proximate the leading edges of the blades. The injection nozzle is located at or upstream of the leading edges of the blades such that the distance from the injection nozzle to the leading edges is from 0% to 100% of the blade span at the leading edge. For example, in one embodiment the injection nozzle is spaced upstream of the leading edges by more than 25% of the blade span at the leading edge, and more particularly by more than 50% of the blade span.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE DRAWINGS

The present invention now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
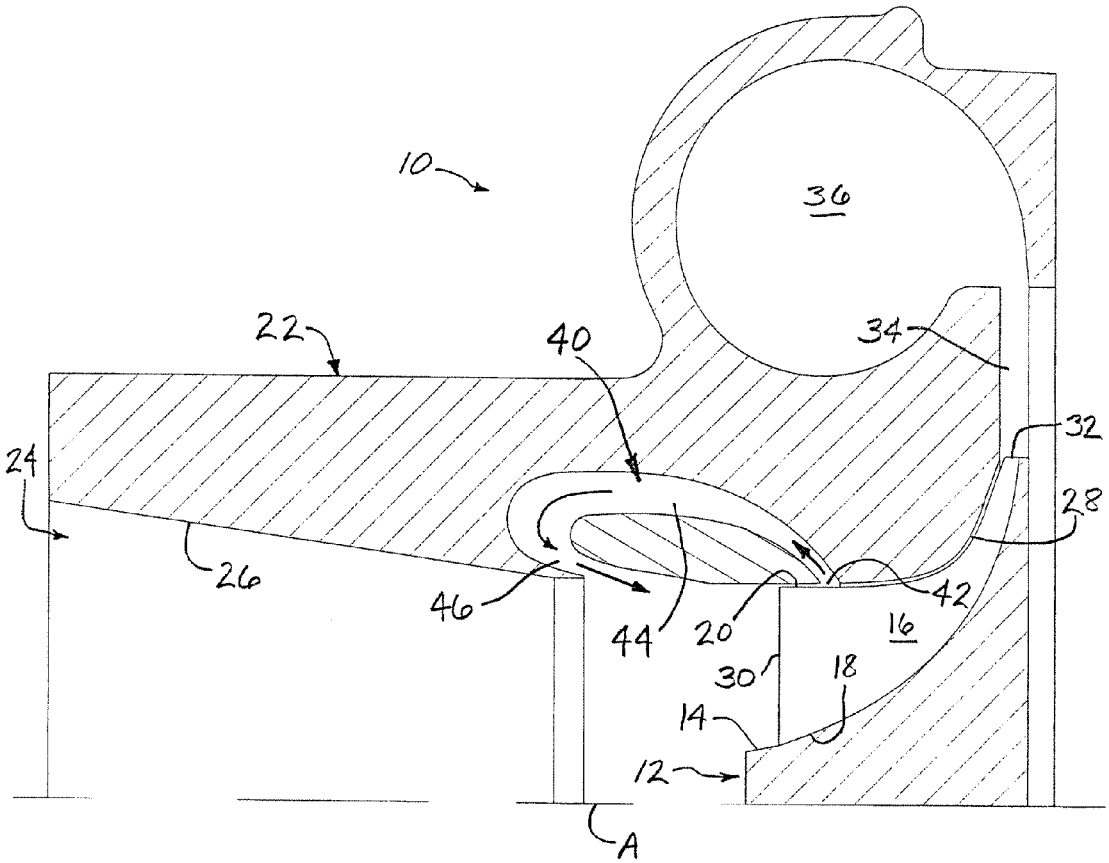
FIG. 1 is a meridional cross-sectional view of a centrifugal compressor in accordance with one embodiment of the invention.

A centrifugal compressor 10 in accordance with one embodiment of the invention is depicted in meridional (i.e., axial-radial) cross-sectional view in FIG. 1. The compressor comprises a compressor wheel 12 having a hub 14 and a plurality of circumferentially spaced blades 16 joined to the hub and extending generally radially outwardly therefrom. Each blade has a root 18 attached to the hub and an opposite tip 20. The compressor wheel 12 is connected to a shaft (not shown) that is rotatable about a rotational axis A and is driven by a device such as a turbine or electric motor (not shown). The compressor wheel is mounted within a compressor housing 22. The compressor housing includes an inlet duct 24 formed by a duct wall 26 that encircles the axis A. The compressor housing further includes a wheel shroud 28 that is radially adjacent the tips 20 of the compressor blades and, together with the hub 14 of the compressor wheel, defines a flowpath for fluid to flow through the blade passages of the compressor wheel. The inlet duct 24 is configured such that the fluid flow approaches the leading edges 30 of the compressor blades 16 in a direction substantially parallel to the rotational axis A. The flowpath defined by the hub and wheel shroud is configured to turn the fluid flow radially outwardly as the fluid flows through the blade passages. The fluid exits the blade passages at the blade trailing edges 32 in a generally radially outward direction (although also having a swirl or circumferential component of velocity) and passes through a diffuser passage 34 into a discharge volute 36 that comprises a generally toroidal or annular chamber surrounding the compressor wheel.

The compressor 10 further includes a bleed flow recirculation system 40 for controlling surge of the compressor. The recirculation system includes a bleed port 42 defined in the wheel shroud 28 at a location intermediate the leading edges 30 and trailing edges 32 of the compressor blades. The bleed port in one embodiment is a substantially uninterrupted full 360° annular port that encircles the tips of the compressor blades. As the fluid flows through the blade passages and is progressively compressed during its flow along the blade passages, a portion of the fluid flow is bled off through the bleed port 42. This bleed portion is partially compressed and thus at a higher total pressure than the fluid entering the compressor inlet duct 24. The bleed portion also has a circumferential or swirl component of velocity because of the action of the rotating compressor blades.

The bleed port 42 is connected to a connecting passage 44 defined in the duct wall 26. In one embodiment, the connecting passage 26 comprises a substantially uninterrupted full 360° annular passage, except for the presence of a relatively small number of support struts (not shown) as further described below. The connecting passage 44 extends in a generally axial direction opposite to the direction of the main fluid flow in the inlet duct 24, to a point spaced upstream (with respect to the main fluid flow) of the compressor blade leading edges. The connecting passage 44 at that point connects with a converging injection nozzle 46 that opens into the main fluid flowpath in the inlet duct 24.

Figure 1A:
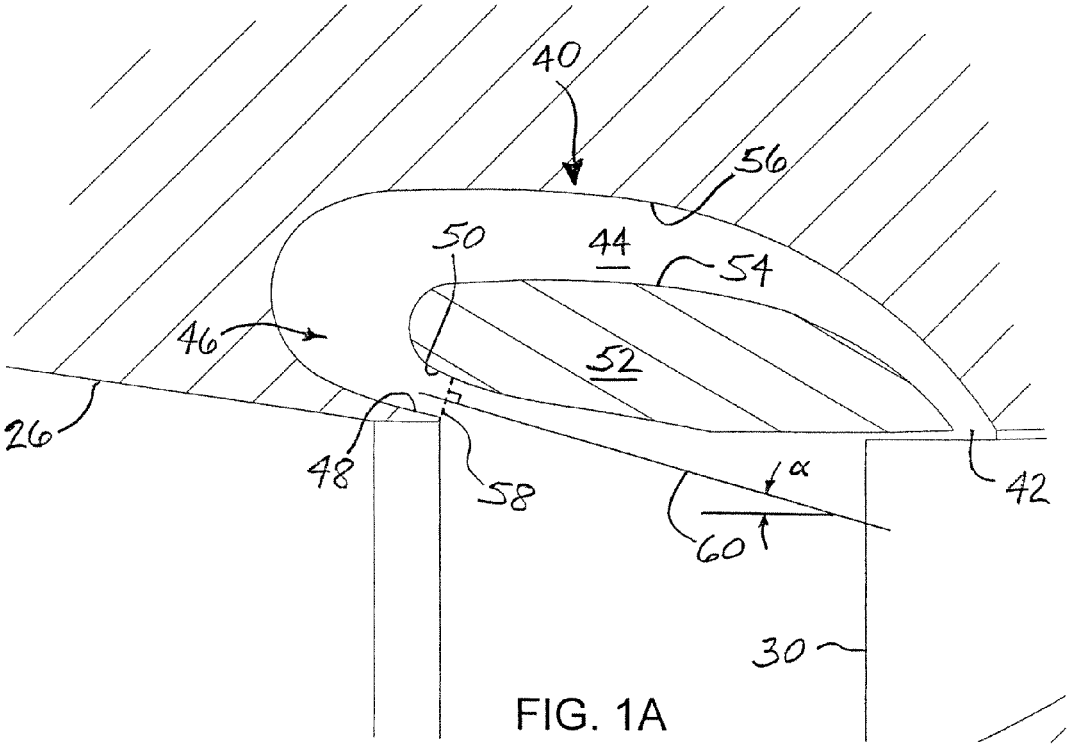
FIG. 1A shows a magnified view of the recirculation system of the compressor.

The injection nozzle in one embodiment is a substantially uninterrupted full 360° annular port. The injection nozzle 46 has a converging shape, meaning that its flow area decreases along the flow direction such that the bleed portion of fluid is accelerated before being injected into the inlet duct 24. In the illustrated embodiment, the injection nozzle is oriented such that the fluid is injected into the inlet duct with a downstream axial velocity component and a radially inward velocity component. The injection nozzle in the illustrated embodiment is oriented and configured such that the axial component of velocity is greater than the radial component of velocity. More particularly, with reference to FIG. 1A showing a magnified view of the recirculation system 40, the injection nozzle is formed by a radially inner wall 48 and a radially outer wall 50. The radially outer wall 50 comprises a radially inner surface of a ring 52 that is disposed adjacent the leading edge tip region of the compressor blades 16. The ring 52 is connected to the duct wall 26 by several (e.g., 3 or 4) circumferentially spaced support struts (not shown) that extend between a radially outer surface 54 of the ring 52 and a radially inwardly facing surface 56 of the duct wall 26. The bleed port 42 and the connecting passage 44 are defined between these two surfaces 54, 56. The surface 48 is an extension of the surface 56 as the passage defined by the connecting passage 44 and the injection nozzle 46 bends through a generally U-shaped bend; similarly, the surface 50 of the ring 52 is an extension of the surface 54. The bleed port 42, connecting passage 44, and injection nozzle 46 collectively form a generally C-shaped flowpath for the bleed portion of the fluid bled from the main fluid flow stream.

The surfaces 48, 50 converge toward each other along the flow direction through the injection nozzle 46, which as noted causes the bleed portion to be accelerated before it is injected back into the main fluid flow stream. When the bleed portion is being injected with a substantial axial component of velocity, the surfaces 48, 50 desirably have some axial overlap as best seen in FIG. 1A. The exit plane 58 of the injection nozzle is defined at the point where the inner wall 48 terminates, the exit plane being substantially perpendicular to the average flow direction at the exit plane. In the illustrated embodiment, the flow area of the nozzle is a minimum at the exit plane 58. As shown in FIG. 1A, a line 60 that is normal to the exit plane 58 (and therefore that is along the average flow direction of the bleed portion as it is injected into the duct) has an axial directional component that exceeds its radial directional component. In the illustrated embodiment, the exit plane 58 of the injection nozzle is spaced upstream of the blade leading edges 30 by a substantial fraction of the leading edge blade span S. For example, the spacing distance can be more than 0.25 S, and advantageously more than 0.5 S. In the illustrated embodiment, the spacing distance is approximately equal to S. More generally, however, the exit plane can be located a distance between 0% and 100% of S from the blade leading edges.

In the illustrated embodiment, the direction of fluid injection represented by the normal line 60 forms an angle $\alpha$ with the rotational axis A. Generally, the angle $\alpha$ can be from about 0° (purely axial) to about 90° (purely radial). It is believed that surge suppression may be particularly facilitated by having some amount of axial velocity component, but purely radial injection is also beneficial.

The bleed port 42 is sized in flow area in relation to the flow area through the main fluid flowpath such that a substantial proportion of the total mass flow is bled off through the bleed port. For example, the bleed can be sized such that at a predetermined operating condition the bleed portion of the fluid comprises more than about 5% of the total mass flow, more particularly more than about 10% of the total mass flow, and in some cases more than about 15% of the total mass flow. The bleed portion can comprise up to about 25% of the total mass flow in some cases. As an example, the flow area of the bleed port can comprise about 5% to 20%, more particularly about 10% to 20%, and still more particularly about 15% to 20% of the flow area of the main gas flowpath at the bleed port location. The substantial proportion represented by the bleed portion of fluid means that the re-injected fluid directed by the injection nozzle 46 can influence a substantial portion of the compressor blades' span. This is in contrast to the types of compressor surge control techniques that have been employed in the past, in which the injected fluid typically may comprise only 1% to 2% of the total mass flow and thus influences only a localized region at the very tip of the blade. In accordance with the embodiments described herein, the recirculated injected fluid is able to influence a wide area of the flow field at the leading edges of the compressor blades. The injected fluid is able to cause a redistribution of the flow field and beneficially impact the surge phenomenon. It is further believed that imparting a substantial axial velocity component to the injected fluid, through the acceleration of the fluid by the injection nozzle and the orientation of the injection nozzle as described above, contributes to the ability to beneficially impact the surge phenomenon.

Figure 2:
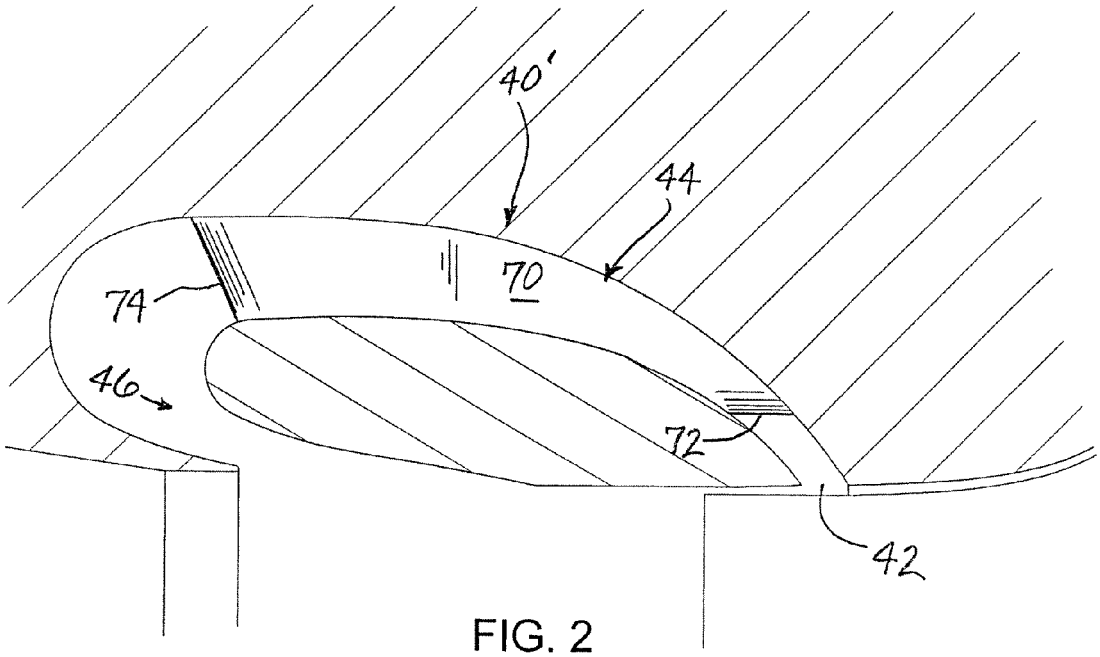
FIG. 2 is a magnified view of a recirculation system in accordance with another embodiment.

FIG. 2 is a view similar to FIG. 1A, showing an alternative embodiment of a recirculation system 40'. The recirculation system is generally similar to the recirculation system 40 previously described, except that guide vanes 70 are arranged in the connecting passage 44 for altering the degree of swirl in the bleed portion of the fluid before it is injected back into the main fluid flow stream. As noted, the bleed portion entering the bleed port 42 has a swirl component of velocity imparted by the rotating compressor blades. It may be desirable in some cases to remove at least a part of the swirl before injecting the fluid for controlling surge. The guide vanes 70 are configured to impart the desired magnitude and direction (i.e., either in the same direction as the blade rotation, termed "preswirl", or in the opposite direction as the blade rotation, termed "counterswirl") of swirl to the fluid. For example, in some cases it may be desirable for the bleed portion to be injected into the main fluid flow stream with substantially zero swirl, and the guide vanes can be configured to accomplish that. In other cases it may be desirable to have some non-zero preswirl or counterswirl, and the guide vanes can be configured accordingly. In the illustrated embodiment, the leading edges 72 of the guide vanes are spaced along the flow direction from the entrance to the bleed port 42, and the trailing edges 74 of the guide vanes are located upstream (with respect to the flow direction of the bleed portion) of the point at which the injection nozzle 46 begins to converge. However, alternative positions of the guide vanes are possible.

In addition to the aforementioned benefits and advantages of the recirculation systems 40, 40' described and illustrated herein, in some embodiments of the invention the entire flowpath traversed by the bleed portion of the fluid, from the entrance to the bleed port 42 to the exit plane 58 of the injection nozzle 46, is free of any abrupt steps. In contrast, in some prior recirculation systems, upstream-facing and/or downstream-facing steps are present that can adversely affect the flow.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A centrifugal compressor for compressing a fluid, comprising:

a centrifugal compressor wheel having a hub defining a rotational axis and having a plurality of circumferentially spaced blades each having a root joined to the hub and extending generally radially outwardly to a tip of the blade, each of the blades having a leading edge and a trailing edge spaced downstream from the leading edge along a flow direction;

a compressor housing in which the compressor wheel is mounted so as to be rotatable about the rotational axis of the compressor wheel, the compressor housing including an inlet duct through which the fluid enters in a direction generally parallel to the rotational axis of the compressor wheel and is led by the inlet duct into the compressor wheel, the fluid flowing along a main flowpath defined by the compressor wheel and compressor housing and exiting the compressor wheel in a generally radially outward direction, the inlet duct comprising a duct wall that encircles the rotational axis, the compressor housing further including a wheel shroud located radially adjacent the tips of the blades;

a bleed port defined in the wheel shroud at a location intermediate the leading and trailing edges of the blades for bleeding off a bleed portion of the fluid being compressed by the compressor wheel, the bleed port being sized in flow area, in relation to a flow area of the main flowpath, such that at a predetermined operating condition the bleed portion constitutes from about 15% to about 25% of the total mass flow entering the compressor; and a converging injection nozzle defined in the duct wall upstream of the leading edges of the blades for injecting the bleed portion of the fluid back into the main fluid flow stream approaching the compressor wheel, the injection nozzle being configured to inject the bleed portion in a direction that makes an angle of from 0° to 90° with respect to the rotational axis, and wherein a flow area of the injection nozzle decreases in the flow direction such that the bleed portion is accelerated before being injected into the main fluid flow stream.

2. The centrifugal compressor of claim 1, wherein the bleed port and injection nozzle each comprises a substantially uninterrupted 360° annular passage.

3. The centrifugal compressor of claim 1, wherein the injection nozzle is defined between a first wall and a second wall, the first wall axially overlapping the second wall such that the bleed portion is injected with a non-zero axial component of velocity.

4. The centrifugal compressor of claim 1, wherein the bleed port is connected to the injection nozzle by a connecting passage defined in the compressor housing.

5. The centrifugal compressor of claim 4, wherein the flowpath defined by the connecting passage and the injection nozzle is free of abrupt steps.

6. The centrifugal compressor of claim 4, further comprising a plurality of guide vanes disposed in the connecting passage and configured to alter a degree of swirl in the bleed portion prior to the bleed portion being discharged through the injection nozzle.

7. The centrifugal compressor of claim 6, wherein the guide vanes are configured to give the bleed portion substantially zero swirl as the bleed portion is injected into the main fluid flow stream.

8. The centrifugal compressor of claim 6, wherein the guide vanes are configured to give the bleed portion a swirl in an opposite direction to the direction of rotation of the compressor wheel as the bleed portion is injected into the main fluid flow stream.

9. The centrifugal compressor of claim 1, wherein the blades at the leading edges have a span S, and the exit plane of the injection nozzle is spaced upstream of the leading edges by a distance of from 0% to about 100% of S.

10. A method for controlling surge of a centrifugal compressor, the compressor comprising a centrifugal compressor wheel having a hub defining a rotational axis and having a plurality of circumferentially spaced blades each having a root joined to the hub and extending generally radially outwardly to a tip of the blade, each of the blades having a leading edge and a trailing edge spaced downstream from the leading edge along a flow direction, and a compressor housing in which the compressor wheel is mounted so as to be rotatable about the rotational axis of the compressor wheel, the compressor housing including an inlet duct through which the fluid enters in a direction generally parallel to the rotational axis of the compressor wheel and is led by the inlet duct into the compressor wheel, the fluid flowing along a main flowpath defined by the compressor wheel and compressor housing and exiting the compressor wheel in a generally radially outward direction, the inlet duct comprising a duct wall that encircles the rotational axis, the compressor housing further including a wheel shroud located radially adjacent the tips of the blades, the method comprising the steps of:

bleeding off a bleed portion of the fluid being compressed by the compressor wheel via a bleed port defined in the wheel shroud at a location intermediate the leading and trailing edges of the blades, the bleed portion constituting from about 15% to about 25% of the total mass flow entering the compressor; and injecting the bleed portion of the fluid back into the main fluid flow stream approaching the compressor wheel via a converging injection nozzle defined in the duct wall upstream of the leading edges of the blades, the injection nozzle being configured to inject the bleed portion in a direction that makes an angle of from 0° to 90° with respect to the rotational axis, and wherein a flow area of the injection nozzle decreases in the flow direction such that the bleed portion is accelerated before being injected into the main fluid flow stream.

11. The method of claim 10, further comprising altering a degree of swirl in the bleed portion prior to the bleed portion being discharged through the injection nozzle.

12. The method of claim 11, wherein the bleed portion exits the injection nozzle with substantially no swirl.

13. The method of claim 11, wherein the bleed portion exits the injection nozzle with swirl opposite to the rotational direction of the compressor wheel.

14. The method of claim 10, wherein the bleed portion is bled at a location proximate the leading edges of the blades.

15. The method of claim 10, wherein the bleed portion is injected back into the main fluid flow stream at a location that is at a distance of from 0% to about 100% of a span of the blades at the leading edges thereof.

* * * * *